United States Patent [19]

Willis et al.

[11] Patent Number: 4,682,778

[45] Date of Patent: Jul. 28, 1987

[54] POLITICAL GAME UTILIZING DIE WITH INTERCHANGEABLE FACES

[76] Inventors: Wayne H. Willis, 2420 Albany Ave., Loveland, Colo. 80537; Keith M. Willis, 8 W. Olive St., Marshalltown, Iowa 50158

[21] Appl. No.: 839,262

[22] Filed: Mar. 13, 1986

[51] Int. Cl.[4] ..... A63F 3/00

[52] U.S. Cl. ..... 273/257; 273/146

[58] Field of Search ..... 273/279, 257, 236, 242, 273/146

[56] References Cited

U.S. PATENT DOCUMENTS

| | | | |
|---|---|---|---|
| 398,233 | 6/1888 | Clarke | 273/279 |
| 1,100,549 | 6/1914 | Elkins | 273/146 |
| 1,143,210 | 9/1914 | Liljencrontz | 273/257 |
| 3,643,958 | 2/1972 | Sperber | 273/257 |
| 3,889,955 | 7/1974 | Welch et al. | 273/257 |

FOREIGN PATENT DOCUMENTS

| | | | |
|---|---|---|---|
| 585312 | 11/1896 | Canada | 273/257 |
| 1140606 | 7/1957 | France | 273/146 |

*Primary Examiner*—Richard C. Pinkham
*Assistant Examiner*—Matthew L. Schneider

[57] ABSTRACT

The game disclosed has a board showing a voting area marked House of Representatives, a voting area marked Senate, a vice-president's voting booth located inside the Senate, and a president's voting booth located between and separate from the House of Representatives and the Senate. Inside both the House of Representatives and the Senate voting areas are eight industry voting booths where players (representing industries) try to accumulate more and more voting chips. An area numbered 2 thru 12 on the game board specifies what is done when each player's turn comes and two regular dice are rolled as a means of chance. Election cards allow players to win voting chips in the House of Representatives, the Senate, the vice-presidency, and the presidency. Politics cards give players a variety of political advantages. Legislation cards target different game industries (players) for potential financial gains or losses, dependent upon votes taken in Congress. A changeable colored die determines which players win election votes and which industries (players) are targeted for financial gains or losses. Players begin the game with a designated sum of game money and try to remain financially solvent. Bankrupt players are eliminated from the game.

3 Claims, 11 Drawing Figures

FIGURE 1

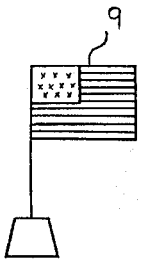
FIG 2
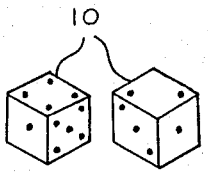
FIG 3
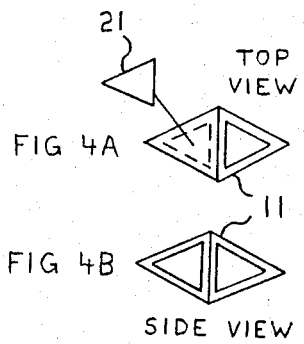
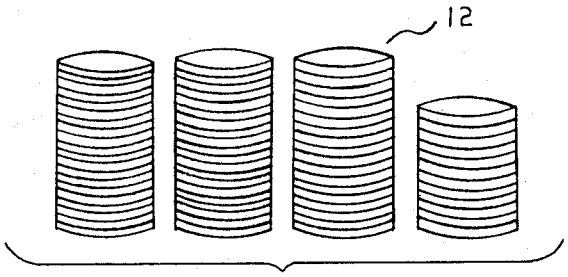
FIG 5
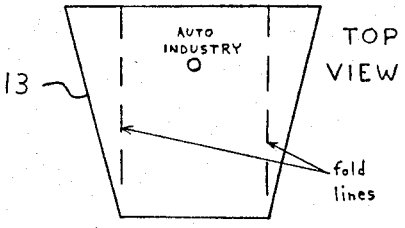
FIG 6
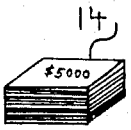
FIG 7
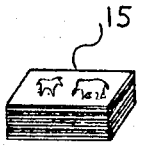
FIG 8
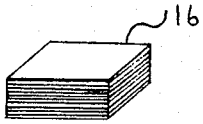
FIG 9
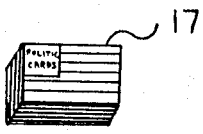
FIG 10

POLITICAL GAME UTILIZING DIE WITH INTERCHANGEABLE FACES

PURPOSE AND BACKGROUND OF THE INVENTION

This invention is intended to offer leisure enjoyment to people while also being educational with regard to real-world political and corporate power struggles. The game is designed to emulate and satire the power and curruption in federal politics and big-business corporations.

A patent search done by this inventor revealed four prior patents with political similarities to Kamakazee Politics. Those patents are U.S. Pat. Nos. 398,233 (Clarke); 585,312 (Harrison, Canada, 11-1896); 1,143,210 (Liljencrantz) and 3,889,955 (Welch et al).

The Legislative Board Game Apparatus, U.S. Pat. No. 3,889,955, is an educational game about politics showing the path that congressional bills follow in getting through Congress. It differs from this board game, Kamakazee Politics, however, in that Legislation cards presented for votes to a House of Representatives and a Senate in the Kamakazee Politics game are financial gains or losses aimed at different industries (players), not actual congressional bills.

BRIEF SUMMARY OF THE INVENTION

The embodiment of this invention includes a game board showing a House of Representatives voting area, a Senate voting area, a vice-president's voting booth located inside the Senate, and a president's voting booth located between and separate from the House of Representatives and the Senate. Within the House of Representatives and the Senate voting areas are eight industry (player) voting booths. Three sets of game cards, Legislation cards, Election cards, and Politics cards, are part of the game with marked spaces on the game board. Two regular dice and one eight-sided changeable colored die are used for means of chance. A box of white and colored voting chips is included and a small flag token is moved from one number to another on the game board area labeled 2 thru 12.

Players represent different game industries and try to vote financial losses or financial gains to each other through Congress. Object of the game is to bankrupt all other players; only one player will remain financially solvent.

BRIEF DESCRIPTION OF THE DRAWINGS

FIG. 2 shows a playing piece used during the game.

FIG. 3 shows two regular dice which are used for means of chance.

FIGS. 4A and 4B show an eight-sided changeable colored die which also is used for means of chance.

FIG. 5 shows white and colored voting chips needed for the game.

FIG. 6 shows one of eight different-colored industry identification money covers used to identify different game players.

FIG. 7 shows the game money.

FIG. 8 shows the game Election cards.

FIG. 9 shows the game Legislation cards.

FIG. 10 shows the game Politics cards.

DESCRIPTION OF THE PREFERRED EMBODIMENTS

Figure 1:
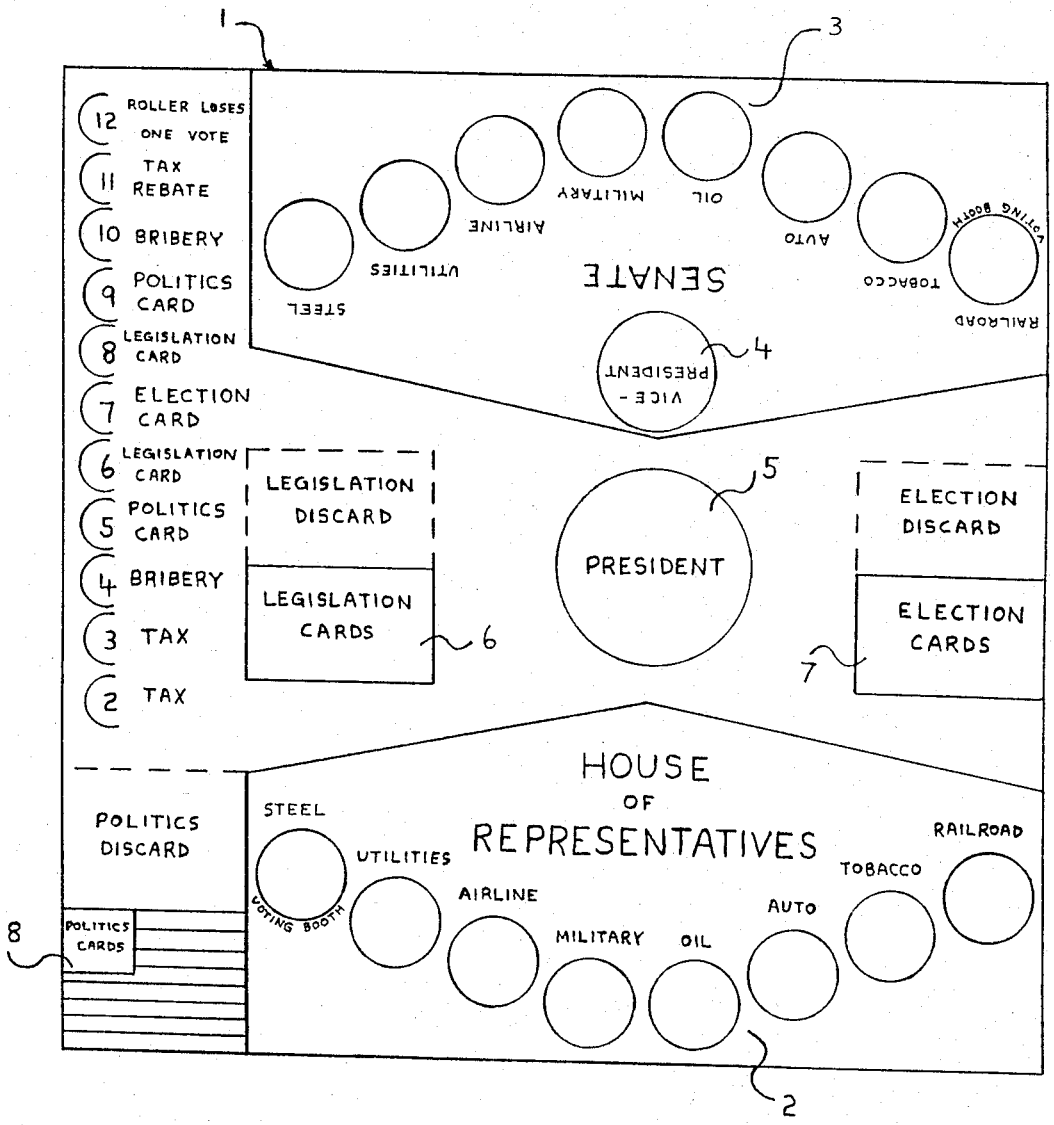
FIG. 1 is a top view of the game board.

The Kamakazee Politics game board 1, shown in FIG. 1, has separate House of Representatives 2 and Senate 3 voting areas. A vice-president's voting booth 4 is located inside the Senate; a president's voting booth 5 is located between and separate from the House of Representatives and the Senate. Eight game industry (player) voting booths are located inside each of the House of Representatives and Senate voting areas. Three spaces are 6, 7, 8 are marked on the game board for game cards, Legislation cards, Election cards, and Politics cards. Following is a detailed description of each set of game cards.

Legislation Cards 16 (Figure 9)

| Number of Cards | Financial Gain or Loss |
|---|---|
| 6 | Loss $75,000 ? |
| 10 | Loss $100,000 ? |
| 12 | Loss $125,000 ? |
| 10 | Loss $150,000 ? |
| 1 | Gain $75,000 ? |
| 2 | Gain $100,000 ? |
| 2 | Loss $75,000 Any active industry of the roller's choice |
| 3 | Loss $100,000 Any active industry of the roller's choice |
| 4 | Loss $125,000 Any active industry of the roller's choice |
| 1 | Loss $150,000 Any active industry of the roller's choice |
| 8 | Roller's choice Loss $75,000 or Gain $50,000 (one card for each of the eight game industries) |
| 8 | Roller's choice Loss $100,000 or Gain $50,000 (one card for each of the eight game industries) |
| 8 | Roller's choice Loss $125,000 or Gain $75,000 (one card for each of the eight game industries) |

All (?) on the Legislation cards are filled in by rolling the changeable colored die 11.

Election Cards 15 (Figure 8)

| Number of Cards | Office(s) Open for Election |
|---|---|
| 2 | President |
| 1 | Vice-President |
| 1 | President and one Senator |
| 1 | Vice-President and one Senator |
| 1 | President and one Representative |
| 1 | Vice-President and one Representative |
| 2 | President and one Office (Vice-Pres, Senate, or House) of the roller's choice |
| 2 | Vice-President and one office (Senate or House) of the roller's choice |
| 1 | President and Vice-President |
| 1 | President, Vice-President and one Senator |
| 1 | President, Vice-President, and one Representative |
| 2 | one Senator |
| 2 | one Representative |
| 2 | one office (House or Senate) of the roller's choice |
| 3 | any one office (Pres, Vice-Pres, Senate, or House) of the roller's choice |
| 2 | two Sentors |
| 2 | two Representatives |
| 2 | one Representative and one Senator |
| 2 | two offices (House and/or Senate-any combination) of the roller's choice |
| 3 | any two offices (Pres, Vice Pres, Senate, or House-any combination) of the roller's choice |
| 1 | two Representatives and two Senators |

The Politics cards 17 shown in FIG. 10 include 18 Buy cards, 9 Gerrymander cards, 8 Lobby cards, 6 Lame-Duck Session cards, 5 Watergate cards, 4 Filibuster cards, 4 Impeach cards, 3 Political Alliance cards, 1 Tax Evasion card, 1 IRS card, and 1 Politician card.

All Politics cards except the one Politician card, which has no value, are worth cash money from the game Treasury or can be used in another way. The Buy card can be used to purchase a House of Representatives or Senate voting chip 12 from the game Treasury; the Gerrymander card can be used to obtain a free House of Representatives or Senate voting chip from the game Treasury. The Lobby card can push any Legislation card (financial gain or loss) through both houses of Congress, regardless of yes or no votes. The Lame-Duck Session card can be used as a Legislation card (financial loss) aimed at any active industry (player) of the card-holder's choice, to be voted on in both houses of Congress. The Filibuster card can block and defeat any Legislation card (financial gain or loss) in the Senate, regardless of yes and no votes in the House and Senate. The impeach card can be used to remove a president from office. The Political Alliance card can be used to force another industry (player) to vote as the card-holder wishes on a Legislation card. The Tax Evasion card can be used to avoid taxation and the IRS card can force all other players to pay a tax in game money to the game Treasury.

The numbers 2 thru 12 on the game board describe what a player does when that player's turn comes and the two regular dice are rolled as a means of chance. Depending upon each player's dice roll, the small flag token, displayed in FIG. 2, is moved as a game piece from one number to another on the game board area labeled 2 thru 12.

An eight-sided changeable colored die 11 is also used during the game as a means of chance. The design shown in FIGS. 4A and 4B provide for thin magnetic colored triangles 21 to be attached to the sides of the die so that the die colors can be changed during the game. Any of a variety of designs or attachment methods can be used for the eight-sided colored die but whatever the design, the colored die must be able to show different colors on the different sides of the die while the odds of the roll cannot be altered.

White and colored voting chips 12, FIG. 5, are needed for the game, approximately 80 white (generic colored) poker chips of average or smaller than average size and 16 colored poker chips of the same size. The 16 colored voting chips include two colored voting chips for each different color of the eight game industries. Each voting chip won by an industry (player) during the game is placed in the proper voting booth of the proper player on the game board and represents one vote.

FIG. 6 shows one of the eight industry identification money covers 13. Each money cover is made of manilla-texture paper, labeled and colored to identify one of the eight game industries, and used to cover a player's game money.

The game money 14 is shown in FIG. 7. Each of the different denominations of game bills, $100,000, $50,000, $20,000 , $10,000, and $5,000, is colored differently for easy identification. Approximately 40 bills of each denomination are needed for play.

Rules for game play are as follows.

To begin the game, each player selects an industry identification money cover and represents that game industry. Each player also receives a starting sum of game money from the game Treasury, the Treasury being the game money held in a money holder. Two to eight players can play the game. With 5–8 players playing, the changeable colored die should show eight different colors, one color for each game industry. When the game has either begun or been reduced to four players, the colored die should be changed so that the four active colors (industries) are each displayed on two sides of the colored die. When the game has either begun or been reduced to two players, the colored die should be changed so that the two active colors (industries) are each displayed on four sides of the colored die.

Players roll for high dice to see which player starts the game. The starting player sorts through the Election cards to find the card that reads "two Representatives and two Senators". That card is turned face up in a discard pile and an open election for two House of Representatives votes and two Senate votes is held. The starting player rolls the one colored die as a means of chance, either once or repeatedly, until the color of an active industry (a player in the game) comes up. That player wins a Representative vote and receives a white voting chip from the game Treasury, placing the voting chip in his/her House of Representatives voting booth. The second Representative vote and then two Senate votes are rolled for by the starting player and won in exactly the same way. Each vote winner receives a white voting chip from the game Treasury and places the voting chip either in his/her House of Representatives or Senate voting booth. When all four voting chips have been rolled for and won, one at a time, the game proceeds as follows. First, the player to the left of the starting player rolls the two regular dice as a means of chance and moves the flag token to the game board number 2 thru 12 indicated by the sum total of the two dice. The roller then does what that board number dictates according to the following game rules.

Game Board Number 2—Tax

All players pay a specified tax in game money to the game Treasury.

Game Board Number 3—Tax

The roller pays a specified tax in game money to the game Treasury.

Game Board Number 4—Bribery

The roller has the option, yes or no, of buying (bribing) a House of Representatives or Senate voting chip from any other player for a specified sum of game money.

Game Board Number 5—Politics Card

The roller receives a Politics card.

Game Board Number 6—Legislation Card

The roller turns up the top Legislation card which is a financial gain or loss for a particular game industry (player). The card may require the roller to roll the changeable colored die as a means of chance to find out which active industry (player) is to be targeted for the said financial gain or loss. The Legislation card (gain or loss) is then presented to the House of Representatives for a yes-and-no vote. A tie or negative "no" vote in the House of Representatives (one vote per voting chip) defeats the proposed financial gain or loss; a majority "yes" vote in the House passes the gain or loss on to the Senate where another yes-and-no vote is taken. A tie or negative vote in the Senate (one vote per voting chip) defeats the proposed financial gain or loss; a majority "yes" vote in the Senate passes the gain or loss on to the president for possible veto. If no president is in office, a financial gain or loss voted through both houses of Congress passes and an industry (player) pays game money to or receives game money from the game Treasury according to what the Legislation card reads. If a president is in office, the President may veto any financial gain or loss voted through both houses of Congress but each presidential veto costs the president a specified sum of game money which is paid to the game Treasury.

Game Board Number 7—Election Card

The roller turns up the top Election card and all players have the chance to win whatever political office(s) are offered by the card. Each player can accumulate any number of votes (white voting chips) in his/her House of Representatives and Senate voting booths as well as gain the vice-presidency and presidency. There can be only one vice-president (one colored voting chip) and one president (one colored voting chip) in office, however, and different players can win those two offices throughout the game.

The office(s) open for election according to what the Election card reads are rolled for, one at a time, by the roller. The roller rolls the changeable colored die as a means of chance and the first active color (industry-player) to come up on the die for each available office wins that office. A voting chip is received from the game Treasury and placed in the office-winner's correct voting booth, representing one vote. White (generic colored) voting chips are used to represent all House of Representatives and Senate votes; colored voting chips are used for the vice-president and president to show which player(s) hold each of those two offices. The Vice-President always has one vote in the Senate; the President holds veto power. Each office offered by the Election card is rolled for by the roller and won in this same manner, one office at a time. Whenever a new president or vice-president is elected, the colored voting chip in office is returned to the game Treasury and replaced by a new colored voting chip from the game Treasury of the new office holder.

Game Board Number 8—Legislation Card

Same as game board number 6.

Game Board Number 9—Politics Card

Same as game board number 5.

Game Board Number 10—Bribery

The roller has the option, yes or no, of buying (bribing) any one voting chip from any other player for a specified sum of game money.

Game Board Number 11—Tax Rebate

The roller receives a specified sum of game money from the game Treasury as a tax rebate.

Game Board Number 12

The roller loses any one voting chip of his/her choice.

When the roller has done whatever the above rules dictate, the roll of dice as a means of chance then passes to the next player on the left. That player rolls the two regular dice, moves the flag token to whichever game board number is indicated by the sum total of the dice roll, and then does what that board number dictates according to the above game rules. The roll of dice as a means of chance continues passing to the left from player to player in this same manner.

Game money can pass between players for voting or veto favors, bribery favors, legislation-decision favors, etc.

When a player loses all cash value, that player is bankrupt and eliminated from the game. Players will succumb to bankruptcy and drop out of the game, one by one, until only a winner remains.

The object of the game is to vote all other players into bankruptcy.

Having thus described this invention and the rules of play, what We claim is this:

1. A board game for a plurality of players comprising: a game board, a plurality of cards and at least two dice; said game board having indicia located thereon representing a Senate voting area and a House of Representatives voting area, each voting area having associated therewith a plurality of representations of different industries, each of said industries being represented by a different first indicia, said game board further including a plurality of second indicia, each of said second indica having associated therewith instructions for the players during play of the game; said plurality of cards having indicia thereon representing various opportunities for election and various advantageous or detrimental instructions to the players during play of the game; said at least two dice comprising a first die and a second die, said first die having a plurality of faces, each of said faces having indicia thereon corresponding to said first indicia on said board, said first indicia on said faces of said first die being removably attachable such that said first die can display various combinations of said first indicia dependent upon the number of players playing the game, said second die having a plurality of faces with each face having indicia thereon corresponding to said second indicia on said board so that upon manipulation of said second die, the players will be directed to one of the instructions on the board associated with one of the second indicia.

2. The board game of claim 1 wherein said first indicia comprises color indicia and said second indicia comprises numerical indicia.

3. The board game as recited in claim 1 and further comprising a third die having a plurality of faces, said faces on said third die having indicia similar to the second indicia on said second die.

* * * * *